US006991011B2

(12) United States Patent
Huhtasalo

(10) Patent No.: US 6,991,011 B2
(45) Date of Patent: Jan. 31, 2006

(54) OPENING ROTOR TYPE DEBARKING MACHINE

(76) Inventor: Jouko Huhtasalo, Siirtolaisentie 20, Pori (FI) FIN-28610

( * ) Notice: Subject to any disclaimer, the term of this patent is extended or adjusted under 35 U.S.C. 154(b) by 0 days.

(21) Appl. No.: 10/363,296

(22) PCT Filed: Sep. 5, 2001

(86) PCT No.: PCT/FI01/00772

§ 371 (c)(1),
(2), (4) Date: Feb. 28, 2003

(87) PCT Pub. No.: WO02/20230

PCT Pub. Date: Mar. 14, 2002

(65) Prior Publication Data

US 2003/0172994 A1 Sep. 18, 2003

(30) Foreign Application Priority Data

Sep. 8, 2000 (FI) ..... 20001986

(51) Int. Cl.
*B27L 1/00* (2006.01)
*B27L 1/08* (2006.01)

(52) U.S. Cl. ..... 144/208.1; 144/208.91

(58) Field of Classification Search .....
144/208.1–208.91, 357, 340; 241/189.1, 241/188.1, 191, 192, 195, 286, 295
See application file for complete search history.

(56) References Cited

U.S. PATENT DOCUMENTS

| | | | | |
|---|---|---|---|---|
| 3,587,684 A | | 6/1971 | Bush, Jr. et al. | |
| 3,970,126 A | | 7/1976 | Allen | |
| 3,987,825 A | * | 10/1976 | Vignolles | 144/208.4 |
| 4,632,164 A | | 12/1986 | Persson | |
| 4,673,012 A | | 6/1987 | O'Brien, Jr. et al. | |
| 4,898,218 A | | 2/1990 | Linderholm | |
| 6,260,592 B1 | | 7/2001 | Lindholm | |

FOREIGN PATENT DOCUMENTS

| | | | |
|---|---|---|---|
| DE | 2 240 921 | | 3/1974 |
| DE | 2 345 267 | | 3/1975 |
| DE | 3623098 | * | 2/1988 |
| FI | 848/69 | | 5/1974 |
| FI | 856/68 | | 2/1992 |
| FI | 982/81 | | 2/1997 |
| SE | 305 066 | | 10/1968 |
| SE | 468 310 | | 12/1992 |
| SE | 468 311 | | 12/1992 |

* cited by examiner

*Primary Examiner*—Derris H. Banks
*Assistant Examiner*—Shelley Self
(74) *Attorney, Agent, or Firm*—Merchant & Gould P.C.

(57) ABSTRACT

The present invention relates to a barking machine which comprises a frame (1), barking rotor (2), which is rotably mounted on the frame (1) and which barking rotor comprises a rotor frame (3), barking blades (4) mounted on the rotor frame (3), and a first power unit (5) mounted on the rotor frame (3) that is connected to the barking blades (T) for transferring the barking force into them. According to the invention, in the barking rotor there is arranged an adjustment device (6) movable with respect to the rotor frame, and a second power unit (7) which is mounted on the frame (3) for transmitting the barking force via the first power unit (5) to the barking blades (4). This solution enables one to adjust the barking depth of the barking blades without stopping the barking rotor.

8 Claims, 4 Drawing Sheets

HYDRAULIC PARTS OF THE BARKING ROTOR

OPENING ROTOR TYPE DEBARKING MACHINE

FIELD OF THE INVENTION

The invention relates to a hole-rotor-type barking machine for barking a log to be put axially through the hole-rotor, in which barking machine the barking blades barking the log are so arranged that they can be adjusted during the barking.

PRIOR ART

The principle of a hole-rotor-type barking machine is to use a rotating rotor which comprises three to six abrasive blades. The log is fed into the rotor by means of a wood-feeding machine attached to the barking machine that has been so arranged as to center the log in the middle of the hole-rotor. While the log approaches the hole-rotor the blades open up. In prior-art barking machines the compression force of the barking blades against the log is achieved by springs and/or hydraulic pressure.

The barking happens in the following manner. The log is fed by a log conveying roll to face the rotating blades, in which case the rotating blades open up and start barking the log with a pre-set barking force. At present, the blade force being applied to the barking blades can only be set when the hole-rotor is standing. The blade force can be adjusted by a separate external pneumatic or hydraulic unit. The bigger the pressure applied to the blades by means of the separate unit, the bigger the blade force applied to the log. The adjustment of the blade force considerably influences the capacity of the barking machine because during the adjustment the barking machine is standing.

In barking it is important that all the bark is removed from the log, but just the bark and nothing else. Therefore it is important that the log can be centered well, that the shape and condition of the blades are appropriate and that the blade pressure is suitable. In addition, in barking, the butt of the log may be shaped by removing the corresponding butt expansion. Usually, for shaping the butt, a separate hole-rotor-type machine is used. Also here the adjustment of the blade pressure during the machining would considerably improve the capacity and the machining work.

With the log properties, such as the thickness of the bark, the moisture, diameter and crooked growth of the log, and the number of the branch stubs, changing it is very important that the blade pressure is adjusted correspondingly. However, at present, the adjustment depends on the activity of the operator of the barking machine and on the other hand on the required capacity of the barking machine. Therefore, the barking machine is usually operated with the wrong blade pressure, in which case the log may get stuck in the barking rotor, or the log may get lathe-turned at the initial step of barking, or there is too little or too much bark removed from the log.

OBJECTIVE OF THE INVENTION

The objective of the invention is to eliminate the above-mentioned disadvantages connected with the capacity and barking result of prior-art barking machines.

One specific objective of the invention is to disclose a new type of barking machine in which the blade pressure can be adjusted during the operation according to the properties of the log being barked, as well as other conditions.

One further objective of the invention is to disclose a barking machine which operates with the optimal barking blade pressure of the log, thereby minimizing the bark left in the log being barked without decreasing the capacity of the machine.

SUMMARY OF THE INVENTION

In the invention there is implemented a barking machine which allows one to bark each log independently based on measurements made of the log by adjusting the blade pressure during the barking. This has been implemented by arranging in the barking rotor a control and adjustment arrangement which allows one to control and adjust the blade pressure of the barking blades while they are rotating and barking the log. The main idea in the invention is to transmit the control and barking force to the rotating barking rotor by adjustment equipment suitable for the purpose.

The invention relates to a barking machine which comprises a frame and a barking rotor rotably mounted on the frame. The frame of the barking machine may be a part of bigger log working equipment which in addition to the barking machine may comprise also other log working devices. The barking rotor comprises a rotor frame and barking blades mounted on it. In addition, the barking rotor comprises a first power unit which is attached to the barking blades and the rotor frame for transmitting the barking force to the barking blades.

According to the invention, the barking rotor comprises an adjustment device that is so arranged that it is movable with respect to the rotor frame, and a second power unit attached to it that has been mounted on the frame of the barking machine for transmitting the barking force from the adjustment device to the first power unit and further on to the barking blades. Due to this, the rotating rotor need not be stopped when adjusting the blade pressure of the barking blades. The adjustment device is advantageously mounted with bearings on the rotor frame and so arranged that it is movable in the direction of the longitudinal axis of the barking rotor.

In one embodiment of the invention, the barking machine comprises a hydraulic system which is connected to the adjustment device, the first power unit and second power unit. The hydraulic system further comprises a hydraulic pump and at least one hydraulic accumulator with a pre-pressure arranged in it. The hydraulic pump is connected to pressure transmission cylinders functioning as the first and second power unit that are used to adjust the blade pressure. In the hydraulic system, pressures are adjusted by means of a pressure regulating valve that has been arranged in the hydraulic system in a manner known in itself.

In one embodiment of the invention, the barking machine comprises a measuring device or equipment for measuring the properties of the log to be fed into the barking rotor. The measuring devices may be used to measure the thickness, moisture, temperature, etc. of the log and the bark. In addition, with the measuring devices it is possible to measure the properties of the butt of the log for trimming the butt of the log. In addition, the barking machine comprises a control device for controlling the barking work of the barking machine. Connected to the control device are a measuring device and hydraulic system, in which case the control device can control the operation of the barking machine based on the measuring information received from the measuring device as well as predetermined control parameters and algorithms.

Thanks to the present invention, each log being barked can be machined and barked independently based on measurements made of the log just before the barking. The invention brings with it considerable savings, since the barking is done with proper blade pressures on the one hand without leaving bark on the wood due to too delicate a barking and on the other hand without wasting the wood being sawn due to too powerful a barking. Furthermore, thanks to the invention, the real-time blade pressure adjustment of the barking machine becomes robust, and as the costs are concerned, easy and advantageous to implement in the existing barking machines.

BRIEF DESCRIPTION OF THE DRAWINGS

In the following section, the invention will be described with reference to the accompanying drawing, in which.

DETAILED DESCRIPTION OF THE INVENTION

Figure 1:
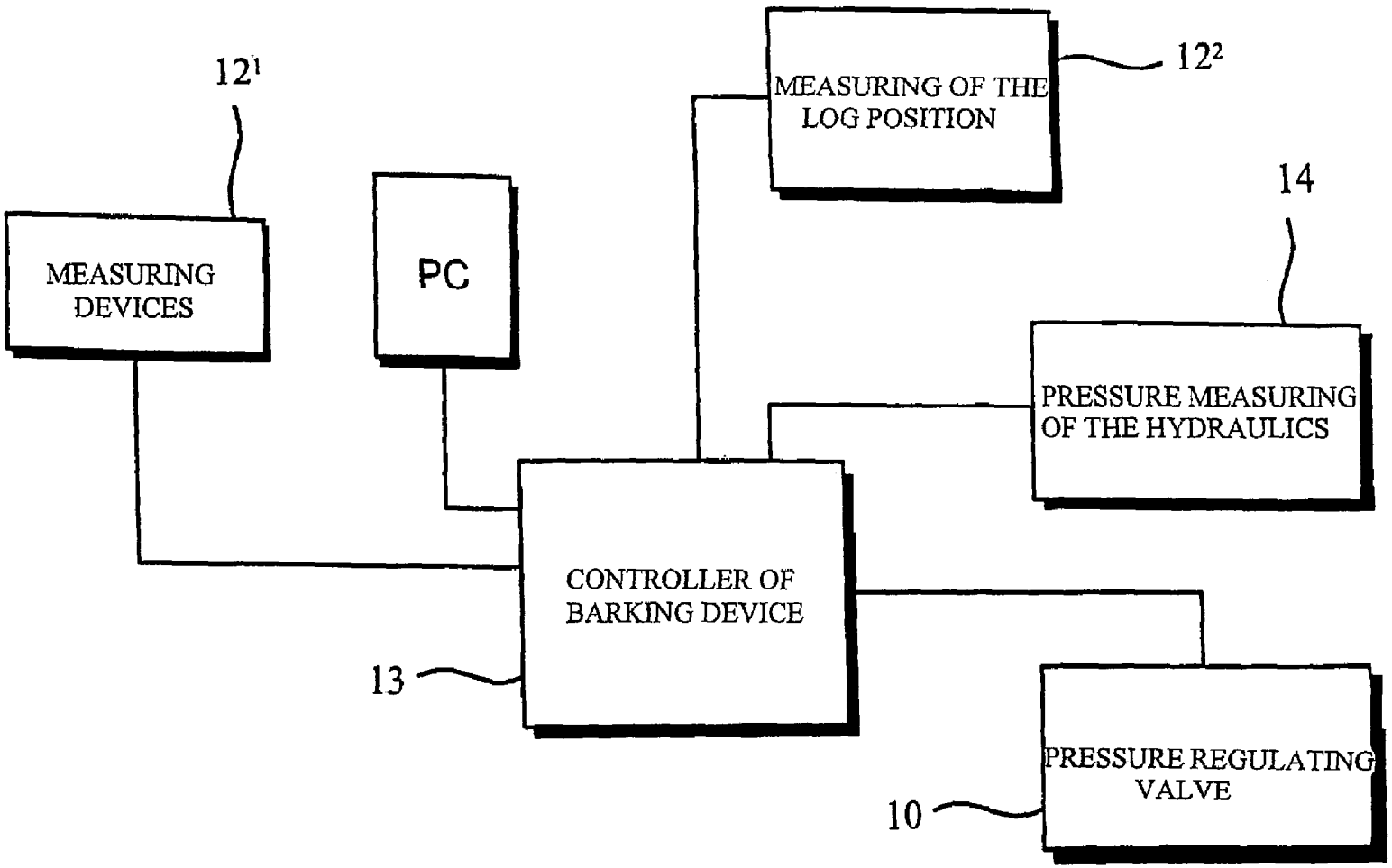
FIG. 1 is a schematic diagram illustrating one control and adjustment system of the barking machine in accordance with the invention.

FIG. 1 is a diagram illustrating the control and adjustment system of one barking machine in accordance with the invention. This figure shows the part of the barking machine that is used to control and measure the barking process and the properties of the log being barked. A measuring device $\mathbf{12}^1$ is used to measure, e.g. the diameter of the log, the thickness of the bark, the moisture, freezing degree, and crooked growth of the log. Also other parameters may be measured. The position of the log is measured either by a three-dimensional measuring device or by a separate indicator of log position $\mathbf{12}^2$. This information allows one to change the blade pressures so that the log goes into the barking rotor with suitable blade pressures, so that there is no turning occurring. The barking is controlled by means of a controller of barking device 13, from which there is a connection to the three-dimensional measuring device $\mathbf{12}^1$, the measuring of the log position $\mathbf{12}^2$, pressure measuring of the hydraulics 14 and pressure regulating valve 10. Besides, to the controller of the barking device 13 it is possible to connect a PC which enables one to easily change the control parameters. On a PC it is also possible to save the measuring information, for each log independently, the blade pressures used, as well as other possible data originating and used in the barking.

Figure 2:
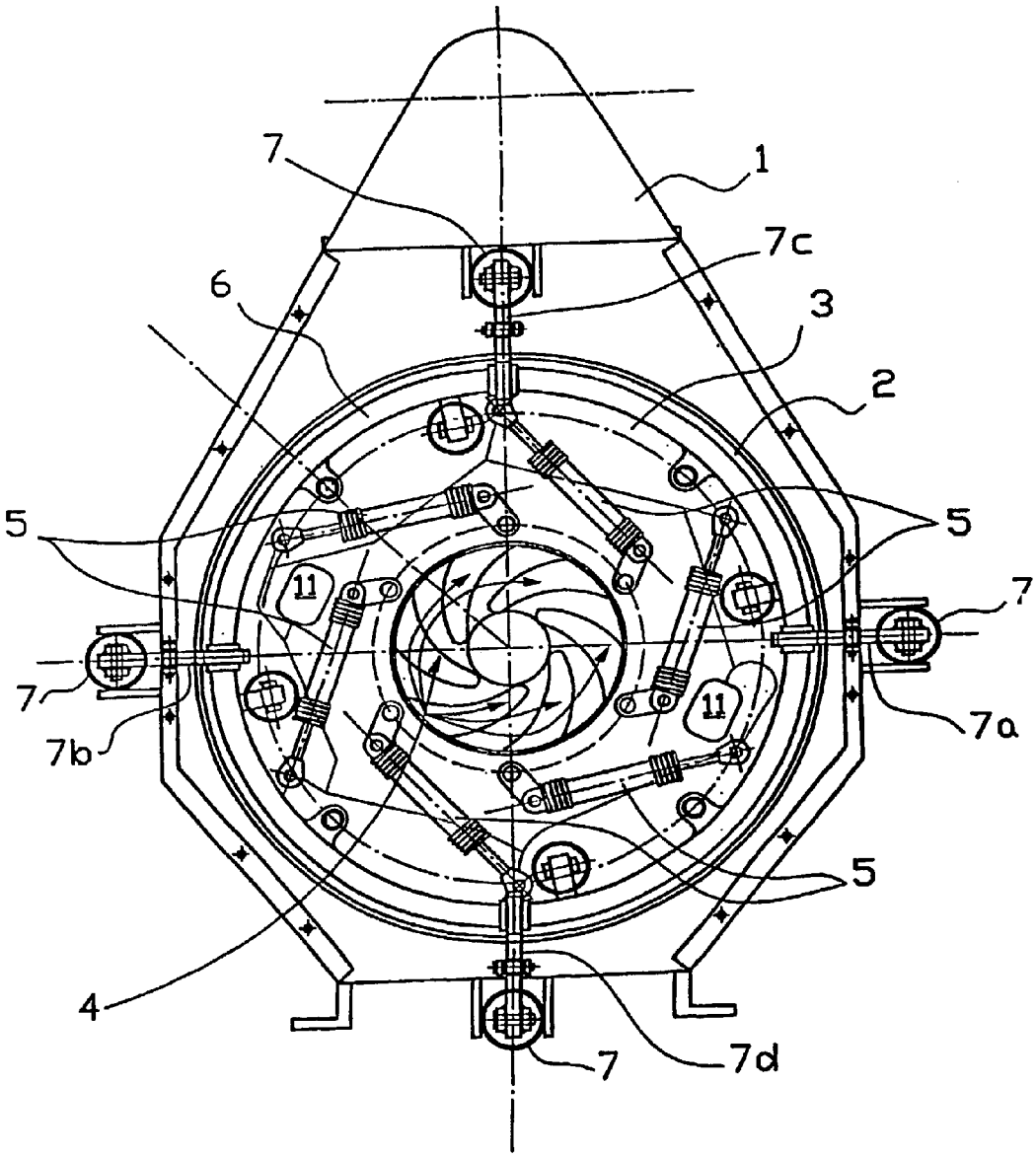
FIG. 2 represents one barking rotor in accordance with the invention as seen from the front.

FIG. 2 represents one barking machine in accordance with the invention as seen from the front. The barking rotor 2 has been rotably mounted on the frame 1 of the barking machine. The barking rotor comprises a rotor frame 3 and barking blades 4 mounted on it. There are altogether six barking blades in this example. In addition, mounted on the rotor frame is a first power unit 5, which here consists of six pressure transmission cylinders altogether. The barking rotor comprises also an adjustment device 6 that is so arranged that it is movable with respect to the rotor frame 3. The adjustment device is a flange-like disc which is pressed by means of a second power unit 7 attached to the barking rotor that here consists of four pressure transmitting cylinders altogether. The flange has been rotably mounted on the barking rotor 2, and the force of the second power unit 7 is transmitted by means of lever arms 7*a*, 7*b*, 7*c* and 7*d* to the adjustment flange 6. In addition, the barking rotor comprises a hydraulic accumulator system 11, in which there is reserved the pre-pressure for the first pressure transmission cylinders 5.

Figure 3:
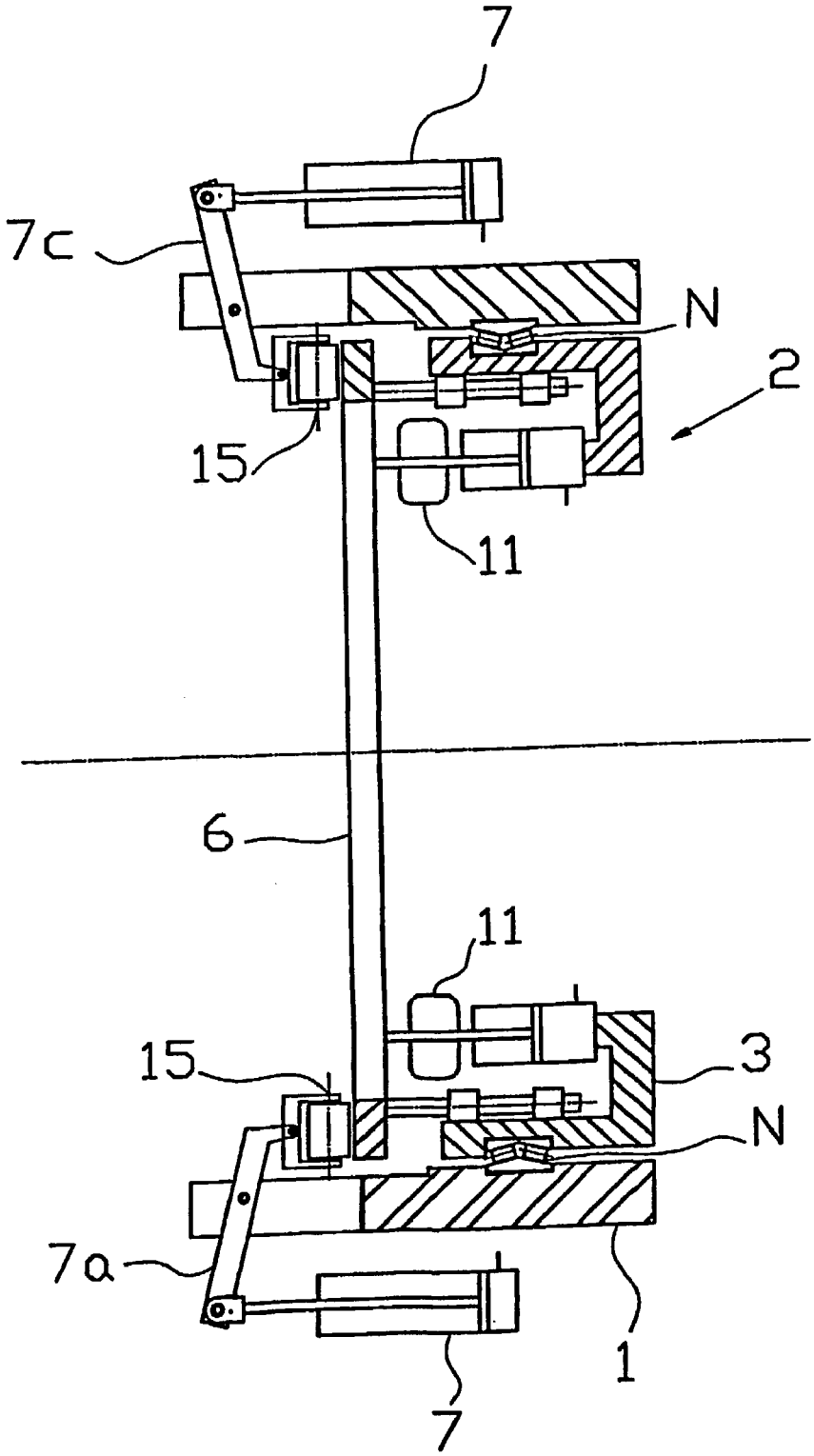
FIG. 3 represents a partly sectioned side view illustrating the barking rotor in accordance with the invention.

FIG. 3 is a cross-sectional illustration of one barking rotor in accordance with the invention as seen from the side. The barking rotor 2 has been rotably mounted on the frame 1 of the barking machine. In FIG. 3, the bearing mounting is illustrated by means of needle bearings N between the frame of the barking machine 1 and the rotor frame 3. The adjustment of the blade pressure of the barking rotor as described in FIG. 3 functions as follows. When increasing the pressure of the pressure transmission cylinders 7 the lever 7*a* and 7*c* gets pressed against the adjustment device 6 by means of bearing mounted push-buttons 15. The adjustment device gets pressed, bearing mounted, further against the hydraulic accumulator system 11 shown in FIG. 2, pressing and thereby increasing the hydraulic pressure in the first pressure transmission cylinders 5. When the pressure of these increases, also the pressure applied to the barking blades increases, and thus the gap between the blades gets smaller, thereby adding to the cutting of the barking blade into the log being barked. When one wishes to decrease the barking force, pressure is released from the pressure transmission cylinders, in which case the adjustment device 6 moves to the left in the direction of the horizontal plane described in FIG. 3, thus releasing the pressure of the hydraulic cylinders 5 and thereby the pressure of the pressure transmission cylinders 5. This adjustment arrangement in accordance with the invention is simple and reliable in operation. It functions reliably also in barking machines in which there are huge twisting and turning forces applied in barking.

Figure 4:
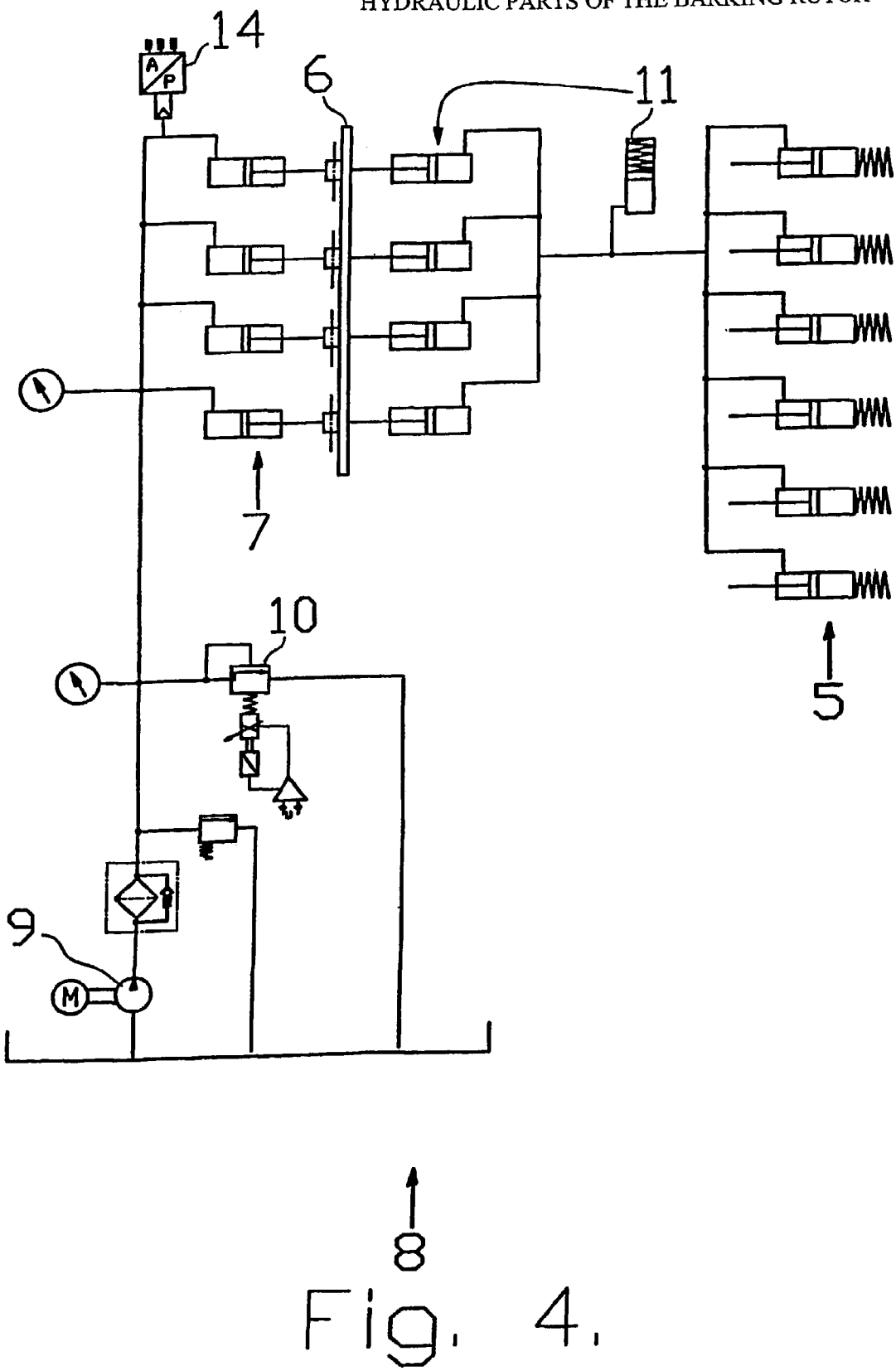
FIG. 4 represents the hydraulic diagram of one hydraulic system in accordance with the invention

FIG. 4 further represents the hydraulic arrangement of the adjustment example described in FIG. 3, which illustrates the idea of barking of the invention. The figure shows, in diagrammatic representation, the hydraulic system of one barking rotor in accordance with the invention as well as the use of the adjustment device as a part of the hydraulic system in adjusting the blade pressure. The hydraulic system comprises a hydraulic pump 9 which is used to achieve the basic pressure of the hydraulic system. In addition, the system comprises a first set of pressure transmitting cylinders 5, which are attached to the barking blades 4 for adjusting and maintaining the blade pressure. The second set of pressure transmitting cylinders are practically outside the barking rotor in connection with the adjustment device 6 and via it with the barking rotor 2. The hydraulic pressure is adjusted by means of a pressure regulating valve 10 and measured by means of a hydraulic pressure meter 14. The notification informing of the position of the adjustment valve and pressure measurement is transmitted to the control device 13 (not shown in FIG. 4), which further controls the position of the pressure regulating valve based on the data received by it. The adjustment of the pressure regulating valve 10 changes the hydraulic pressure of the second set of pressure transmission cylinders and thus influences the position of the adjustment device 6, thereby adjusting the pressure of the hydraulic accumulator system 11. As the pressure of the hydraulic accumulator system 11 changes, also the pressures of the first set of pressure transmission cylinders change, which directly influences the blade pressures of the barking blades 4. This kind of hydraulic arrangement may, as concerns its mechanical part, be implemented also in some other manner than by using the adjustment device 6 presented in these examples. In the same way, the basic idea of the hydraulic system presented functions also in a pneumatic system, when the pneumatic components have been fitted appropriately. Furthermore, in the adjustment system one has to fit the interoperation of the work cylinders, adjustment device, and other parts appropriately so that the needed hydraulic pressures at the upper and lower limit are achieved. The adjustment is, however, case-specific, depending on the barking rotor being used, number of blades, etc.

The invention is not restricted merely to the examples of its embodiments referred to above, instead many variations are possible within the scope of the inventive idea defined by the claims.

What is claimed is:

1. A barking machine comprising:

a barking machine frame, a barking rotor having a longitudinal axis and rotatably mounted on the barking machine frame, wherein said barking rotor comprises:

a rotor frame, bearings, barking blades rotably mounted on the rotor frame, a first power unit mounted on the rotor frame and connected to the barking blades, an adjustment device for adjusting a barking force and movable with respect to said rotor frame, a second power unit connected to the adjustment device and mounted on the frame for positioning the adjustment device, wherein the adjustment device mounts on the rotor frame and is movable along the direction of the longitudinal axis of the barking rotor providing for adjustment of the barking force while the rotor is rotating, wherein the barking force is determined by the position of the adjustment device, and wherein the second power unit positions the adjustment device to actuate the first power unit and transmit the barking force to said barking blades.

2. The barking machine according to claim 1, wherein the barking machine comprises a hydraulic system connected to the adjustment device, the first power unit, and the second power unit.

3. The barking machine according to claim 2, wherein the hydraulic system comprises:

a hydraulic pump, wherein the first and second power units are pressure transmission cylinders connected to the hydraulic pump for transferring a hydraulic force into them.

4. A barking machine comprising:

a barking machine frame, a barking rotor having a longitudinal axis and rotatably mounted on the barking machine frame, wherein said barking rotor comprises:

a rotor frame, bearings, barking blades rotably mounted on the rotor frame, a first power unit mounted on the rotor frame and connected to the barking blades, an adjustment device for adjusting a barking force and movable with respect to said rotor frame, a second power unit connected to the adjustment device and mounted on the rotor frame for actuating the adjustment device wherein the adjustment device mounts on the rotor frame with the bearings and is movable in the direction of the longitudinal axis of the barking rotor providing for adjustment of the barking force while the rotor is rotating, wherein the barking force is determined by the position of the adjustment device, and wherein the second power unit positions the adjustment device to actuate the first power unit and transmit the barking force to said barking blades, wherein that the barking machine further comprises a hydraulic system connected to the adjustment device, the first power unit, and the second power unit, wherein the hydraulic system comprises:

a hydraulic pump, wherein the first and second power units are pressure transmission cylinders connected to the hydraulic pump, and wherein the hydraulic pump transfers a hydraulic force to the first and second power unit pressure transmission cylinders, a pressure regulating valve; and a hydraulic accumulator having a pre-pressure for the first power unit pressure transmission cylinders.

5. The barking machine according to claim 1, wherein the adjustment device is a disc having a flange.

6. The barking machine according to claim 1, wherein the barking machine comprises a measuring device for measuring properties of a log fed into the barking rotor.

7. The barking machine according to claim 1, wherein the barking machine comprises a control device for controlling operation of the barking machine.

8. The barking machine according to claim 3, wherein the hydraulic system comprises a hydraulic pressure meter for measuring the pressure of the first and second power unit pressure transmission cylinders.

* * * * *